US010056063B2

(12) United States Patent
Lavieille et al.

(10) Patent No.: US 10,056,063 B2
(45) Date of Patent: Aug. 21, 2018

(54) METHOD OF PRODUCING A MICRO-CHANNELED MATERIAL AT ATMOSPHERIC PRESSURE

(71) Applicants: Airbus Operations (S.A.S.), Toulouse (FR); Georgia Tech Research Corporation, Atlanta, GA (US)

(72) Inventors: Maud Lavieille, Tournefeuille (FR); Jason H. Nadler, Decatur, GA (US); Michael Beckert, Atlanta, GA (US)

(73) Assignees: Airbus Operations (S.A.S.), Toulouse (FR); Georgia Tech Research Corporation, Atlanta, GA (US)

( * ) Notice: Subject to any disclaimer, the term of this patent is extended or adjusted under 35 U.S.C. 154(b) by 233 days.

(21) Appl. No.: 15/189,589

(22) Filed: Jun. 22, 2016

(65) Prior Publication Data

US 2017/0372687 A1 Dec. 28, 2017

(51) Int. Cl.

| | |
|---|---|
| ***F01D 5/18*** | (2006.01) |
| ***G10K 11/162*** | (2006.01) |
| ***D01F 9/28*** | (2006.01) |
| ***G10K 11/16*** | (2006.01) |

(52) U.S. Cl.
CPC ..... *G10K 11/162* (2013.01); *D01F 9/28* (2013.01); *G10K 11/16* (2013.01)

(58) Field of Classification Search
CPC ..... G10K 11/162; G10K 11/16; D01F 9/28
USPC ..... 428/586
See application file for complete search history.

(56) References Cited

U.S. PATENT DOCUMENTS 7,963,364 B2 * 6/2011 Nadler ..... G10K 11/16 181/293

* cited by examiner

*Primary Examiner* — William K Cheung
(74) *Attorney, Agent, or Firm* — Jenkins, Wilson, Taylor & Hunt, P.A.

(57) ABSTRACT

A micro-channeled material is fabricated from a bundle of metal-plated polymer fibers by a process wherein the polymer fibers are heated to a first temperature and pyrolyzed in the presence of an inert gas at atmospheric pressure.

22 Claims, 3 Drawing Sheets

METHOD OF PRODUCING A MICRO-CHANNELED MATERIAL AT ATMOSPHERIC PRESSURE

TECHNICAL FIELD

The present disclosure is directed towards a method for producing a micro-channeled material. The present disclosure is also directed towards a micro-channeled material so produced, as well as an array of such micro-channeled materials.

BACKGROUND

Noise reduction is often challenging, in machine systems generally and in turbomachinery in particular. Acoustic noise-reduction devices must be designed to ensure sufficient and effective noise reduction in a given frequency range of interest, but also comply with integration constraints. These include temperature, weight, drainage, structural behavior, installation, damage prevention, and so on.

However, of the solutions that have been developed over the years, few are well adapted to broadband noise reduction.

To this end, so-called micro-channeled materials have been developed. A micro-channeled material is a structural material formed of thin-walled-metal tubes disposed in an array, such as a honeycomb-like structure.

U.S. Pat. No. 7,963,364 describes an example of such a structure, wherein the micro-channel structure comprises an array of tubes each having a nominal diameter of between approximately 100 μm and 300 μm.

Such a structure is advantageous, in that it allows for good noise attenuation over a wide frequency range, in particular for frequencies above 1 kHz. Moreover, the thin walls of the micro-channels offer a significant weight reduction with respect to insulation structures based on more conventional narrow-band Helmholtz-type resonators.

These micro-channel structures are fabricated by plating nickel metal onto a polymer wire mandrel in a thin layer, thereby forming the micro-channels. The coated wire is then placed in a crucible. The crucible is heated under a strong vacuum, to approximately 400° C., at which point the polymer material of the wire mandrel breaks down and is ingested by the vacuum pumping system. After leveling off for approximately one hour, the crucible is then heated to approximately 1200° C. The temperature is leveled off for long enough to allow the micro-channels to fuse to each other, and then cooled.

However, using a strong vacuum is disadvantageous: in order to protect the vacuum pumps, which are easily contaminated by the products of the pyrolysis, elaborate filtration systems must be developed and maintained. Furthermore, furnace design and material selection are also difficult, not only in terms of maintaining the vacuum seals but also due to the fact that since carbon is favorably deposited on high-temperature surfaces during decomposition, any exposed heating elements will experience significant fouling which ultimately results in electric arcing and failure.

It is therefore an object of the disclosure herein to resolve at least some of the above-mentioned issues.

SUMMARY

According, therefore, to a first aspect of the disclosure herein, there is provided a method for producing a micro-channeled material from a plurality of metal-plated polymer fibers, comprising consolidating the metal-plated polymer fibers into a bundle, the metal-plated polymer fibers extending in parallel along a longitudinal direction of the bundle; heating the bundle to a first temperature in the presence of an inert first gas at atmospheric pressure, thereby pyrolyzing the polymer fibers and obtaining a plurality of metal channels, a carbonaceous residue remaining in the bundle.

This method is advantageous in that it removes the polymer substrate from the plated metal tubes without requiring that it be performed in a vacuum. As a result, the cost and difficulty involved in providing and operating the equipment necessary for providing a vacuum is eliminated, rendering the process of fabricating the multi-channeled material much simpler and more economical.

Moreover, the carbonaceous residue that results from the pyrolysis according to this method will hold the nickel micro-channels together in the desired orientation until such time as they can be sintered together. As a result, the manipulation of the bundle is rendered much easier and more efficient.

The use of atmospheric pressure rather than a vacuum also advantageously allows the composition of the gas to be tailored to the particular characteristics of the application in question, in particular to achieve the desired decomposition reactions and rates. The process is therefore far more flexible than the vacuum decomposition method known in the art.

In a possible embodiment, the method further comprises a cooling step after the heating step, wherein the bundle is cooled to ambient temperature in the presence of the inert first gas.

Advantageously, the method further comprises a sectioning step after the cooling step wherein the bundle is shaped by cutting or grinding substantially transversely to a longitudinal direction of the bundle, thereby producing a plurality of bundles.

Preferably, the first temperature is between 500° C. and 700° C., and most preferably 600° C.

Most preferably, during the step for heating to the first temperature the bundle is first heated an intermediate temperature ($T_1$) at a first rate, and then to the first temperature ($T_2$) at a second rate that is less than the first rate.

In a preferred embodiment, the method further comprises the steps of heating the bundle to a second temperature; oxidizing at the second temperature the carbonaceous residue of the pyrolyzed polymer fibers in the presence of a reactive second gas at atmospheric pressure, thereby producing carbon dioxide gas; reducing the carbon dioxide gas to carbon monoxide gas at the second temperature in the presence of the reactive second gas at atmospheric pressure; and sintering the metal channels at the second temperature.

Preferably, the reactive second gas is carbon dioxide.

Most preferably, the bundle is maintained at the second temperature between the oxidizing and reducing steps.

Advantageously, the reducing step is performed substantially concurrently with the oxidizing step.

Preferably, during the step for heating the bundle to the second temperature, the bundle is surrounded by nitrogen gas until the second temperature is reached.

In a practical embodiment, the step or steps for heating are performed in a radiatively-heated furnace.

In such an embodiment, the inert first gas and/or the reactive second gas may be streamed past the bundle from a gas input to an exit of the furnace.

Preferably, the flow rate of the inert first gas and/or the reactive second gas is a function of the differential in carbon dioxide content of the gas streamed into the gas input and the gas issuing from the exit of the furnace.

Preferably, the second temperature is between 700° and 900° C., and most preferably 890° C.

In a possible embodiment, the polymer is nylon and the metal is nickel.

According to a second aspect, the disclosure herein is directed towards a micro-channeled material produced by the method as described above.

Preferably, the metal channels are open-ended at both sides thereof.

According to a third aspect, the disclosure herein is directed towards an array comprising a plurality of micro-channeled materials as described above.

Preferably, the plurality of micro-channeled materials are arranged on a surface, preferably a three-dimensionally curved surface, and notably a cylindrical surface.

BRIEF DESCRIPTION OF THE DRAWINGS

Other particularities of the disclosure herein will become apparent in the following discussion of the figures, in which.

DETAILED DESCRIPTION

A structure comprised of channels has been envisioned as a high-efficiency acoustic absorber. These channels can be normally oriented to the incident acoustic waves, or oriented at a desired angle. Additionally, these channels can have a defined range of angles relative to both one another and the incident waves Channel spacing can also be defined by controlling channel wall thickness or channel packing, e.g. hexagonal, square or other variations. Along their surfaces, these channels can serve either as discretized volumes of fluid, or be designed to have holes or gaps such that fluid in one channel may predictably interact with those in neighboring channels and beyond.

Figure 1:
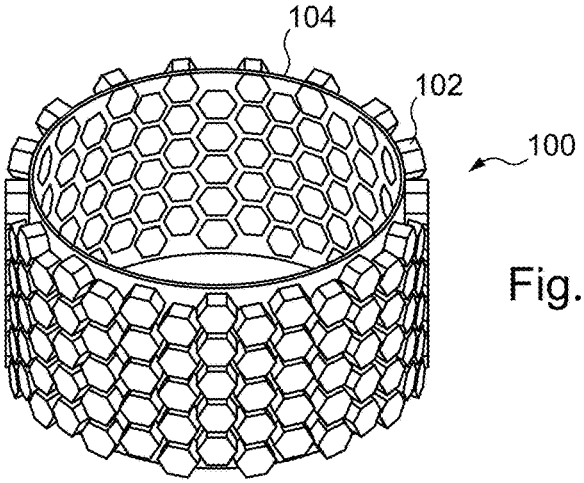
FIG. 1 is a perspective view of an array of micro-channeled materials oriented on a cylindrical surface.
Figure 2:
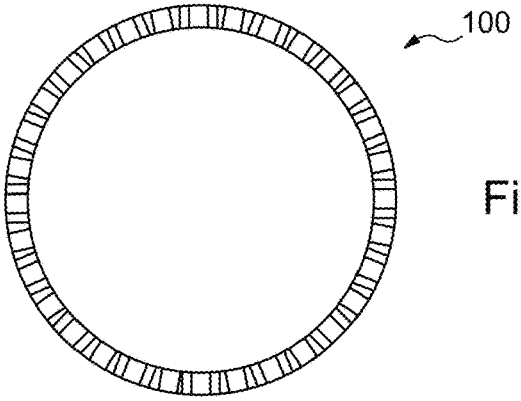
FIG. 2 is a plan view of the array of FIG. 1.
Figure 3:
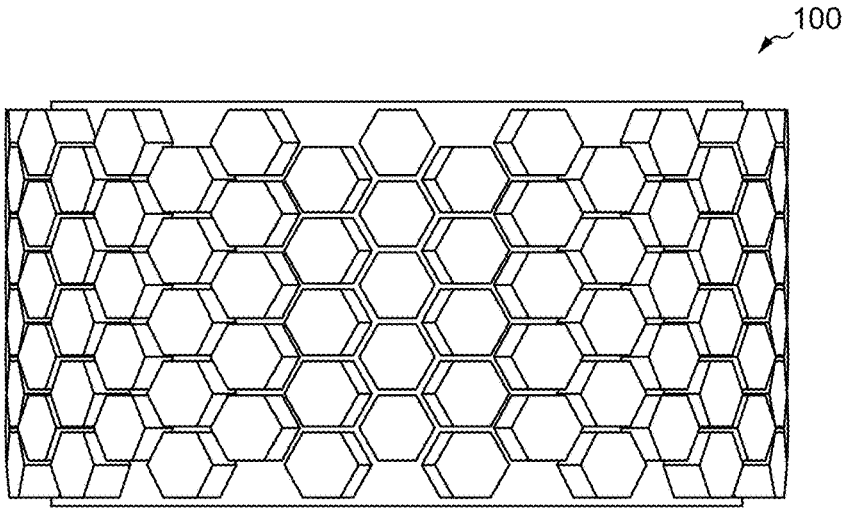
FIG. 3 is a side view of the array of FIG. 1.

Arrays of these micro-channeled structures can be arranged as grouped or individual geometric elements such that surfaces of any form can be achieved, such as a flat layer, a rectilinear prism, or even a three-dimensionally curved surface such as depicted in FIGS. 1 to 3.

In FIGS. 1-3, an array 100 comprises a plurality of micro-channeled structures 102. The micro-channeled structures 102 are provided in the form of hexagonal prisms, and are tessellated across a surface 104.

Structural elements can be arranged on a frame (a hexagonal mesh as in FIG. 1-3, for example), while a secondary frame can be added to secure the opposing surface.

Acoustic noise reduction devices must be designed to ensure sufficient noise attenuation within a given frequency range of interest, but also comply with integration constraints. These include temperature, weight, drainage, structural behavior, installation, damages prevention, etc.

The micro-channeled material allows good noise attenuation over a large frequency range, including frequencies down to a few hundred hertz. In order to adapt the design to the targeted optimum efficiency, different parameters can be adjusted, such as the liner depth and the channel diameter. The overall porosity is targeted to be as high as possible, above 95%

This can be achieved thanks to the thickness of the channel's walls, comprised between 2 and 10 microns; generally, the thickness will be chosen according to the desired structural attributes of the micro-channeled material, with consideration being paid to the desired degree of porosity which is a function of wall thickness.

Most technologies available today also cannot comply with installation requirements such as withstanding the high temperatures induced by grazing flow propagation along the liners. The micro-channeled technology as defined in the present document can stand very high temperatures.

Along with temperature, other integrations constraints must be considered and different installation concepts can be envisaged. The liner channels can for example be inclined without any effect on the liner acoustics properties. Channel orientation could be modified to obtain desired, directional or integration limited applications, such as flow considerations or cooling.

Air cavities can also be used on the backing face of the liner, such as the micro-channels can be open-ended on both sides. This is of particular interest to ensure correct drainage and prevent the liner from freezing. It also allows better thermal insulation properties by reducing heat conduction. Experiments shown it is possible to assess the acoustics impact of such design and enhance the overall efficiency of layered porous media. Moving this backing may be done to optimize the frequency range of interest.

Initial fabrication steps may include depositing materials onto a sacrificial substrate, such as a polymer fiber, followed by consolidation.

Figure 4:
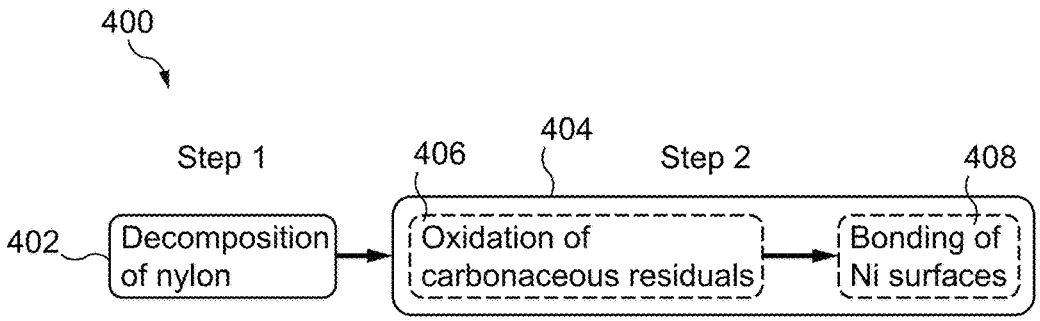
FIG. 4 is a schematic heat treatment process according to an embodiment of the disclosure herein.

To facilitate the creation of a porous, thin-walled, micro-channeled material following metal deposition on a polymer substrate, it is necessary to remove the substrate via a two-step heat treatment process 400, as depicted in FIG. 4.

In this two-step process, a first step 402 involves the decomposition of the polymer substrate. A second step 404 involves two distinct reactions: a first reaction 406 wherein the carbonaceous residuals left over from the first step 402 are oxidized, and a second reaction 408 for the bonding of the metal surfaces of the micro-channeled material.

While in FIG. 4 the reactions 406, 408 are depicted separately for the sake of clarity, these reactions need not necessarily be conducted sequentially. Rather, it may be envisioned that the first reaction 406 and the second reaction 408 overlap, or are even carried out substantially simultaneously.

The heat treatments take place in a standard electric, radiatively-heated surface that can withstand oxidizing environments up to 1000° C.

The initial step is an inert pyrolysis of the polymer substrate and the second step is by a carbon gasification step. The details of the heating steps follow.

The processes described below attain a unique balance between the oxidation of the polymer substrate and non-oxidation of metal. Also, the process is designed to supply enough energy to allow for the self-diffusion between metal channel walls to form bonds but not enough such that the channeled structure is lost. The novelty and uniqueness of the approach is finding suitable heating environments that balance these competing effects and are practical to implement.

Pyrolysis refers to thermochemical decomposition of organic material at elevated temperature.

The initial heating in an inert atmosphere serves to pyrolyze the polymer substrate. Any inert gas can be used to achieve the inert atmosphere; however, nitrogen is preferable due to its low cost and availability. Successful pyrolysis of polymer depends both on temperature and heating rate. The process must be carried out slowly enough for the decomposition reactions to proceed to completion without damaging the metal channels during the phase changes accompanying polymer decomposition.

In any case, however, the composition and flow rate of the inert gas can be chosen so as to achieve the desired decomposition reaction (which may vary according to the substrate composition), and to carry it out at the desired rate so as to avoid deleterious effects on the metal channels. These parameters will naturally vary according to the composition of the polymer substrate and the metal plating.

Thus, the inert gas flow rate is adapted to achieve the desired decomposition reactions and rates, which will depend on the attributes of the particular polymer employed as a substrate.

For example, in the case of a nylon substrate this can be achieved relatively efficiently by heating to 300° C. at 1° C. per minute followed by heating from 300° C. to 600° C. at 0.5° C. per minute. In order to maintain the inert atmosphere, an appropriate flow rate of inert gas must be selected to expel the products of pyrolysis, which is dependent on both the flow characteristics of the surface and the amount of polymer to be removed. Successful removal of the polymer is marked by a matrix of channels that are adhered to one another by the residual carbon remaining from the pyrolysis.

A key advantage of pyrolysis methods is the formation of a rigid, carbonaceous residue coating the surfaces of the remaining structure. This residue provides a temporary scaffold by which further shaping steps such sectioning by saw or grinding can be accomplished without damaging the overall structure and preserving the fine walled, open-celled micro-channels that are exposed upon sectioning.

Cutting a metallic micro-honeycomb in the transverse direction relative to the micro-channels can easily result in damage to the overall structure and smearing or folding over of the thin walled micro-channels. Alternatively, the resulting metallic structure can be infiltrated with material such as wax that can reinforce the structure for cutting, and be melted or dissolved out after cutting/shaping.

Following the heat treatment in an inert atmosphere, the second heat treatment takes place in an oxidizing atmosphere to facilitate the removal of residual carbon. Carbon dioxide is used as an oxidizer:

$$C_{(s)}+CO_2 \leftrightarrow 2CO_{(g)}$$

Carbon gasification becomes only slightly thermodynamically favorable and proceeds slowly at temperatures between 700 and 900° C. Efficient removal carbon and avoidance of significant creep deformation in the metal channels takes place at approximately 890° C., and since the reaction driving force is relatively small, the heating rate is limited by the furnace.

After reaching 890° C., the furnace is allowed to dwell at this temperature for 8-15 hours, depending on carbon content, sample size and the partial pressure of carbon dioxide, to allow for complete removal of the carbon and sintering of the metal tubes. It is very important to maintain a carbon dioxide rich environment, and the flow rate must be carefully selected based on the flow conditions within the furnace and the amount of carbon to be removed.

In the temperature range between 700 and 900° C., carbon dioxide is preferable to oxygen as an oxidizing agent for several important, non-intuitive reasons. Since oxidation with carbon dioxide proceeds slowly, a carbon dioxide rich environment minimizes the effect of concentration gradients and permits the reaction to proceed at a uniform rate throughout the sample thereby reducing the stress on the metal tubes.

Furthermore, in the stated temperature range, carbon dioxide strongly favors the oxidation of carbon in contrast to metal. This is an important advantage over oxygen because in the stated temperature range metal readily reacts to form nickel (II) oxide which is very fragile and the stresses induced by the transformation generally destroy the channel structure.

Moreover, nickel (II) oxide is less dense than nickel metal. Its presence in the microchannel structure will thereby cause fractures, since it will expand at a faster rate than the surrounding metallic nickel.

Lastly, since the rate of metal self-diffusion is appreciable in the stated temperature range, after the carbon is removed there is sufficient time and energy for the metal tubes to sinter without the hindrance of oxidation.

Below a certain material-dependent lower limit temperature (for instance approximately 700° C., in the case of nickel), heating rate, dwell time, and oxygen concentration (>1% by volume), it was found that during the removal of carbon significant stresses developed on the surface of the metal channels sufficient enough to cause the free ends of the channels to curl closed effectively ruining the sample. This effect was not observed if the addition of oxygen followed heating in an inert atmosphere.

Of course, it will be readily understood that the pertinent temperature values may vary in other embodiments where other metals or alloys are employed, and the person of skill in the art will be able to adjust the process accordingly to achieve the desired results.

Notably, the method is appropriate for any metal/polymer combination where non-oxidative thermal decomposition is possible.

Indeed, it may be preferable to use a polymer material for the substrate which is specifically formulated to facilitate good metal deposition and to decompose with minimal reaction products, for instance polyethylene carbonate.

The following discussion of an embodiment of the process should not, therefore, be construed as being limited to certain polymers and metals or combinations thereof, but as exemplary of the disclosure herein.

Figure 5:
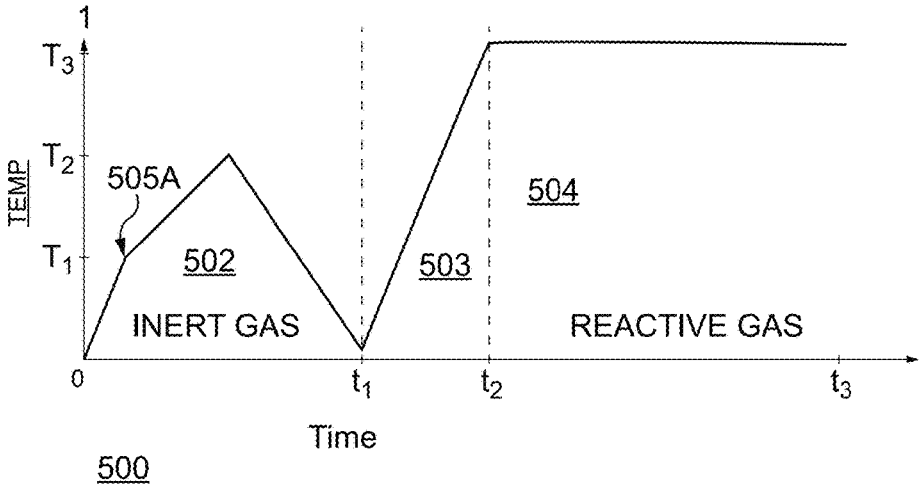
FIG. 5 is a diagram of a heat-treatment process according to the embodiment of FIG. 4.

FIG. 5 depicts a heat-treating process 500 according to an embodiment of the disclosure herein.

The process 500 comprises a decomposition phase 502 in which the polymer fibers are decomposed by pyrolysis. In a decomposition phase 502, the bundle of polymer fibers is heated to a first temperature $T_2$ at which pyrolysis can take place, but in the presence of an inert first gas rather than in a vacuum.

More particularly, it will be noted that the heating to the first temperature $T_2$ takes place in two steps: to an intermediate temperature $T_1$ at a first rate, and then to the first temperature $T_2$ at a second rate that is slower than the first rate. This change in heating rate is illustrated by an inflection point 502A.

By way of example, when nylon is the substrate material and nickel is the metal plating material, the bundle is first heated to approximately 300° C. (the intermediate temperature $T_1$) at a rate of 1° C. per second, and then to a first temperature $T_2$ of approximately 600° C. at a rate of 0.5° C. per minute.

Of course, other materials may require different heating profiles; the exact parameters (rate, duration, temperature, etc.) may be determined by known methods such as thermogravinometric and differential thermal analyses.

Moreover, the flow rate of the inert first gas is controlled so as to regulate the speed of the pyrolysis reaction, This two-stage heating is advantageous, in that it reduces thermal strain in the nickel micro-channels and, as a result, maintains a greater degree of dimensional stability therein.

Because an inert first gas atmosphere replaces the vacuum of the method of the prior art, there is no need to provide a vacuum pump or the accompanying filters, manifolds, plumbing, etc., nor does one incur the substantial maintenance load that are frequently implicated in the vacuum pyrolysis methods known in the art.

It should be recognized that the temperature at which the pyrolysis occurs will generally be in the range of 500° C. to 700° C.; 600° C. is a preferred temperature for most applications. More particularly, it will be noted that the temperature will ultimately depend on the pyrolytic decomposition characteristics of the polymer used. The temperature will also depend on the characteristics of the metal plated on it, namely the high-temperature strength of the metal (to avoid creep) and the oxidation resistance of the metal in the presence of $CO_2$ at such temperatures.

Once the pyrolysis process is complete and the bundle cooled to ambient temperature, an oxidation/reduction phase 504 commences at time $t_1$.

However, it should be noted that the cooling depicted here is not strictly necessary to execute the method according to the disclosure herein; it may be preferable to simply continue heating the bundle and change to the reactive second gas once the polymer has sufficiently pyrolyzed. At another extreme, the bundle may even be stored for a period of time, until such time as it may be desirable to complete the fabrication process.

Nonetheless, it will be understood that it is not necessarily the case that the oxidization phase follows promptly after the decomposition phase. This offers a degree of flexibility in the implementation of the process in a production context.

Perhaps most advantageously, the carbonaceous residue present in the bundle after the decomposition phase will retain the metal channels therein and, as a result, make it easier to cut, grind, or otherwise shape the bundle, in particular once it has been cooled to ambient temperature. Thus, it may be envisioned that there is a sectioning step executed between the decomposition phase 502 and the oxidization/reduction phase 504.

Subsequently, the bundle is rapidly heated to a second temperature $T_3$, at which the oxidation and reduction reactions take place, between time $t_1$ and $t_2$.

Advantageously, during the period of time between $t_1$ and $t_2$, the bundle is surrounded by an inert gas atmosphere (for instance the nitrogen gas atmosphere illustrated here), in a pre-heating step 503.

The pre-heating step 503 allows the bundle to enter an oxidation phase 604 without running the risk of unwanted decomposition reactions during heating to the second temperature $T_3$, which may cause an undesired deformation of the metal micro-channels.

Once the second temperature $T_3$ is reached at time $t_2$, the flow of reactive gas past the bundle is commenced, and the bundle is maintained at that temperature through the duration of the oxidization/reduction phase 504. During this phase, the carbonaceous residue will oxidize while the formation of metal oxides in the micro-channels will be prevented, and the metal micro-channels will sinter to each other to create the micro-channeled structure.

The reactive gas composition and flow rate is chosen, taking into account the composition of the metal micro-tubes and the polymer substrate, so that the oxidization of the carbonaceous residue and the reduction & sintering of the metal channels occurs substantially simultaneously during the oxidization/reduction phase 604. This offers a considerable advantage in the form of simpler process operation and control and reduced process time. Generally speaking, the duration of the oxidization/reduction phase 504 is between 8 and 15 hours, though this will of course vary with the composition and size of the micro-channeled structure in question.

At the completion of the oxidization/reduction phase 504 at time $t_3$, the process is completed and the bundle of metal micro-tubes is allowed to cool to ambient temperature.

Figure 6:
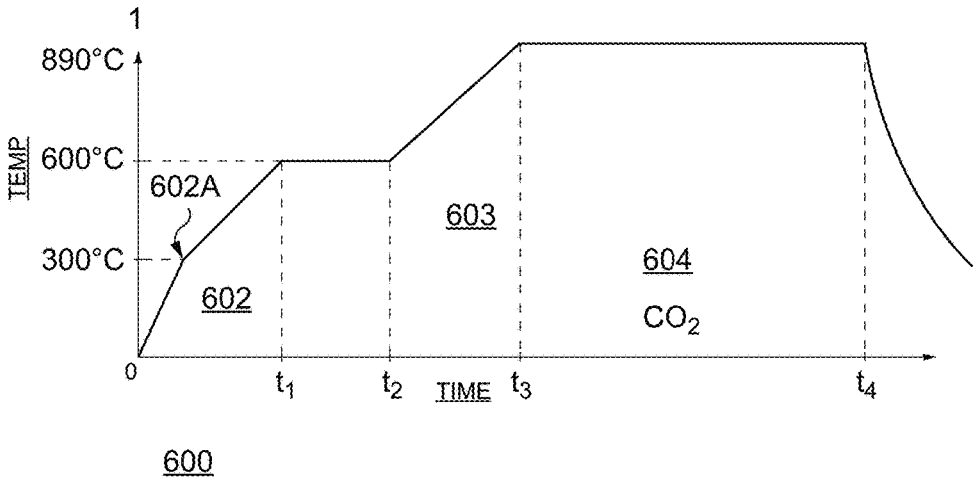
FIG. 6 is a diagram of a heat-treatment process according to a variant of the embodiment of FIG. 4.

FIG. 6 discloses a heat-treatment process 600, which is a variant of the process 500 discussed above as applied to nickel micro-tubes formed on a nylon substrate. As in the process 500, there is a decomposition phase 602, wherein the nylon fibers are pyrolyzed in the presence of an inert gas.

However, the temperature curve of the decomposition phase 602 is similar to that of the decomposition phase 502, in that the heating of the bundle is heated rapidly to approximately 300° C., then less rapidly to the peak temperature of approximately 600° C. This change in heating rate is illustrated by an inflection point 602A.

Once the bundle temperature has reached the first temperature of approximately 600° C. at approximately $t_1$, it is held there until a time $t_2$ when all of the nylon substrate has pyrolyzed.

Unlike the embodiment discussed in FIG. 5, there is no cooling-down between the decomposition phase 602 and a reduction/oxidization phase 604; rather, the bundle is directly heated to the higher reduction/oxidization phase temperature once the pyrolysis is completed. Such an embodiment precludes the cutting of the carbonaceous-residue-infused bundle as mentioned above, but reduces overall process time.

Once pyrolysis is completed at time $t_2$, the process continues un-interrupted into a heating phase 603 occurring between time $t_2$ where heating begins and time $t_3$ at which the desired temperature is reached. The bundle is heated to a second temperature of approximately 890° C. in the presence of the same inert gas atmosphere that was employed during the decomposition phase 602.

Thus, the reduction/oxidation phase 604 is begun at time $t_3$, wherein the remaining carbonaceous residues in the bundle are oxidized to carbon monoxide gas in the presence of carbon dioxide gas.

As discussed above, the forward direction of the carbon gasification reaction is, from a thermodynamic standpoint, most favorable at elevated temperatures (i.e. above 700° C.). Thus, the preheating phase 603 also favors the efficient removal of the carbonaceous residue.

In fact, as noted above the oxidization reaction is carried out most effectively at temperatures between 700° C. and 900° C. Thus, 890° C. is considered ideal, in that it achieves the best results from the gasification reaction and thus the most effective removal of the carbonaceous residue.

Moreover, the use of carbon dioxide as the oxidizer will prevent the formation of nickel oxides in the micro-tubes, which might otherwise form if a different oxidizing gas is employed. This is advantageous in that the presence of nickel oxides would weaken the structure of the nickel micro-tubes. This continues until the time $t_4$, at which point the process 600 is complete and the micro-channeled material so produced is allowed to cool to ambient temperature.

Figure 7:
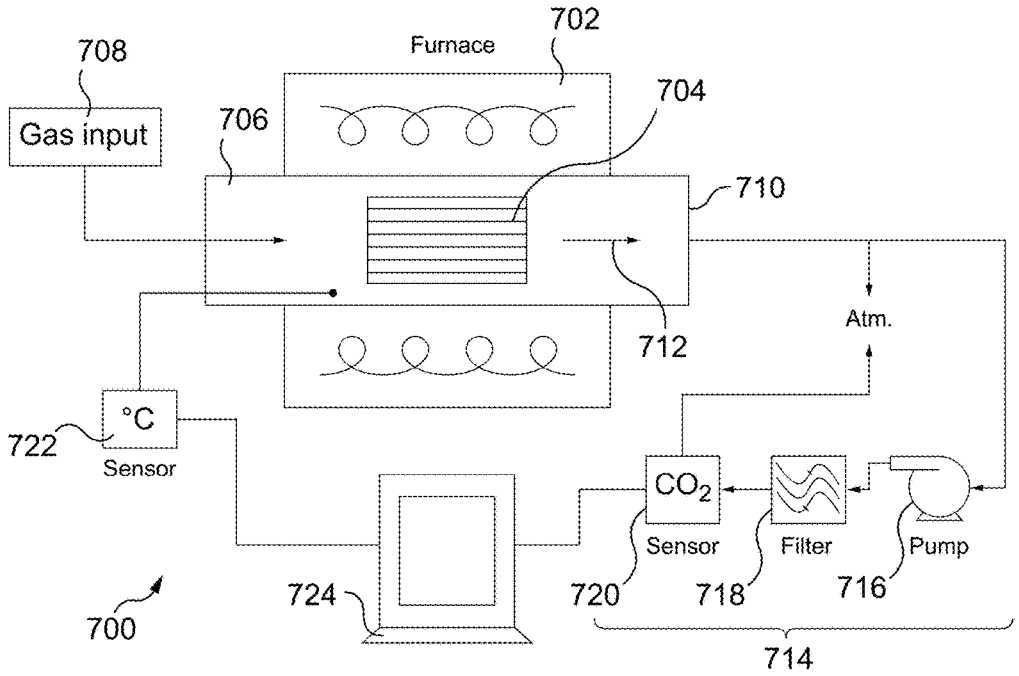
FIG. 7 is an exemplary apparatus for carrying out the process according to the disclosure herein.

Turning now to FIG. 7, an exemplary apparatus 700 for carrying out a method according to the disclosure herein is now discussed. The apparatus 700 comprises a furnace 702, into which a bundle 704 of metal-plated polymer fibers is placed.

The furnace 702 is preferably a radiatively-heated furnace, comprising e.g. quartz lamps or resistive heating elements. However, other types of heating the bundle 704 are envisioned.

The furnace 702 comprises a globally cylindrical chamber 706, which comprises a gas input 708 at one end and an exit 710 at an opposite end. During phases of the heat-treatment process, the gas input 708 creates a stream 712 of the various gases past the bundle 704, as appropriate to the current phase of heat treatment. The gas input 708 should therefore be regarded as representative of the various gas sources, cylinders, manifolds, concentrators, etc. that may be employed to furnish and select the various gases that might be used.

Once the stream 712 issues from the exit 710, most of it is discharged to atmosphere. However, a sampling section 714 is provided to assist in the control of the process. The sampling section 714 comprises a pump 716, a filter 718, and a carbon dioxide sensor 720, which act in concert to detect the concentration of carbon dioxide in the stream 712. By extension, this serves to determine the rate at which the polymer and its carbonaceous residue are removed from the bundle during the decomposition and reduction/oxidization phases.

In combination with a temperature sensor 722 disposed within the furnace, and a control unit represented by a PC 724, the speed and duration of the process are monitored and controlled, and possibly automated, by the continuous monitoring and control of the temperature, gas flow rate, and carbon dioxide content of the exhaust from the furnace 702.

It will be noted that the scope of the patent should be construed as extending to all modifications envisioned above, insofar as they form a part of the contribution of the inventors to the art. Such modifications, substitutions, and alternatives may be realized without going beyond the scope and spirit of the present disclosure.

While at least one exemplary embodiment of the invention(s) is disclosed herein, it should be understood that modifications, substitutions and alternatives may be apparent to one of ordinary skill in the art and can be made without departing from the scope of this disclosure. This disclosure is intended to cover any adaptations or variations of the exemplary embodiment(s). In addition, in this disclosure, the terms "comprise" or "comprising" do not exclude other elements or steps, the terms "a", "an" or "one" do not exclude a plural number, and the term "or" means either or both. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

The invention claimed is:

1. A method for producing a micro-channeled material from a plurality of metal-plated polymer fibers, comprising:

consolidating the metal-plated polymer fibers into a bundle, the metal-plated polymer fibers extending in parallel along a longitudinal direction of the bundle; and heating the bundle to a first temperature in presence of an inert first gas at atmospheric pressure, thereby pyrolyzing the polymer fibers and obtaining a plurality of metal channels, a carbonaceous residue remaining in the bundle.

2. The method according to claim 1, further comprising a cooling step after the heating, wherein the bundle is cooled to ambient temperature in the presence of the inert first gas.

3. The method according to claim 2, further comprising a sectioning step after the cooling step wherein the bundle is shaped by cutting or grinding substantially transversely to a longitudinal direction of the bundle, thereby producing a plurality of bundles.

4. The method according to claim 1, wherein the first temperature is between 500° C. and 700° C.

5. The method according to claim 4, wherein the first temperature is approximately 600° C.

6. The method according to claim 1, wherein during heating to the first temperature, the bundle is first heated to an intermediate temperature at a first rate, and then to the first temperature at a second rate that is less than the first rate.

7. The method according to claim 1, wherein heating the bundle to the first temperature is performed in a radiatively-heated furnace.

8. The method according to claim 7, wherein the inert first gas is streamed past the bundle from a gas input to an exit of the furnace.

9. The method according to claim 8, wherein a flow rate of the inert first gas is a function of the differential in carbon dioxide content between the gas streamed into the gas input and the gas issuing from the exit of the furnace.

10. The method according to claim 1, further comprising:

heating the bundle to a second temperature;

oxidizing at the second temperature the carbonaceous residue of the pyrolyzed polymer fibers in presence of a reactive second gas at atmospheric pressure, thereby producing carbon dioxide gas;

reducing the carbon dioxide gas to carbon monoxide gas at the second temperature in the presence of the reactive second gas at atmospheric pressure; and sintering the metal channels at the second temperature.

11. The method according to claim 10, wherein the reactive second gas is carbon dioxide.

12. The method according to claim 10, wherein during heating the bundle to the second temperature, the bundle is surrounded by nitrogen gas until the second temperature is reached.

13. The method according to claim 10, wherein heating the bundle to the second temperature is performed in a radiatively-heated furnace.

14. The method according to claim 13, wherein the reactive second gas is streamed past the bundle from a gas input to an exit of the furnace.

15. The method according to claim 14, wherein a flow rate of the reactive second gas is a function of the differential in carbon dioxide content between the gas streamed into the gas input and the gas issuing from the exit of the furnace.

16. The method according to claim 9, wherein the second temperature is between 700° C. and 900° C.

17. The method according to claim 16, wherein the second temperature is approximately 890° C.

18. The method according to claim 1, wherein the polymer is nylon and the metal is nickel.

19. A micro-channeled material produced by a method for producing a micro-channeled material from a plurality of metal-plated polymer fibers, the method comprising:

consolidating the metal-plated polymer fibers into a bundle, the metal-plated polymer fibers extending in parallel along a longitudinal direction of the bundle; and heating the bundle to a first temperature in presence of an inert first gas at atmospheric pressure, thereby pyrolyzing the polymer fibers and obtaining a plurality of metal channels, a carbonaceous residue remaining in the bundle.

20. The micro-channeled material according to claim 19, wherein the metal channels are open-ended at both sides thereof.

21. An array comprising a plurality of micro-channeled materials according to claim 19.

22. The array according to claim 21, wherein the plurality of micro-channeled materials are arranged on a surface, wherein the surface is a three-dimensionally curved surface or a cylindrical surface.

* * * * *